US005676562A

United States Patent [19]

Fukuda

[11] Patent Number: 5,676,562

[45] Date of Patent: Oct. 14, 1997

[54] CONNECTOR ADAPTED TO BE MOUNTED ON A GLASS PLATE

[75] Inventor: Kiyohito Fukuda, Shizuoka-ken, Japan

[73] Assignee: Yazaki Corporation, Tokyo, Japan

[21] Appl. No.: 740,615

[22] Filed: Oct. 31, 1996

Related U.S. Application Data

[63] Continuation of Ser. No. 278,254, Jul. 21, 1994, abandoned, which is a continuation of Ser. No. 32,651, Mar. 17, 1993, abandoned.

[30] Foreign Application Priority Data

Mar. 18, 1992 [JP] Japan ..... 4-14622 U

[51] Int. Cl.[6] ..... H01R 13/62

[52] U.S. Cl. ..... 439/329; 439/357; 439/595

[58] Field of Search ..... 439/329, 350–358, 439/493, 595, 596, 599

[56] References Cited

U.S. PATENT DOCUMENTS

| | | | |
|---|---|---|---|
| 4,060,295 | 11/1977 | Tomkiewicz | 439/595 |
| 4,695,112 | 9/1987 | Maston et al. | 439/350 |
| 5,015,197 | 5/1991 | Redmond et al. | 439/329 |
| 5,035,644 | 7/1991 | Nakazato et al. | 439/488 |
| 5,051,100 | 9/1991 | Kato et al. | 439/595 |
| 5,190,477 | 3/1993 | Akeda | 439/595 |

FOREIGN PATENT DOCUMENTS

| | | |
|---|---|---|
| 56-78170 | 6/1981 | Japan . |
| 3411413 | 8/1991 | Japan . |
| 353425 | 11/1991 | Japan . |

*Primary Examiner*—Hien Vu

*Attorney, Agent, or Firm*—Wigman, Cohen, Leitner & Myers, P.C.

[57] ABSTRACT

A connector for connecting a terminal and a conductor attached to a glass plate comprises a first connector and a second connector. The first connector is fixedly mounted on the glass plate and has a fitting hood bridging the conductor. The fitting hood has a first opening which opens towards the conductor. The second connector has a body to be fitted into the fitting hood. The body has a terminal accommodating chamber for accommodating the terminal and a second opening which allows a part of the terminal to project towards the conductor.

13 Claims, 4 Drawing Sheets

CONNECTOR ADAPTED TO BE MOUNTED ON A GLASS PLATE

This is a continuation of application Ser. No. 08/278,254, filed on Jul. 21, 1994, now abandoned, which is a continuation of Ser. No. 08/032,651 filed on Mar. 17, 1993 now abandoned.

BACKGROUND OF THE INVENTION

This invention relates to a connector which is mounted on a glass plate to connect a terminal and a long conductor attached to a glass plate.

FIG. 1 shows a rear window glass 1 of an automobile. Referring to FIG. 1, the rear window glass (hereinafter referred to as a "glass plate") 1 of the automobile is provided with an antifogging resistor wire 3 printed thereon. Referring to FIG. 2, the resistor wire 3 printed on the glass plate 1 has a wide portion 5. A plate-like male terminal 7 has one end attached to the wide portion 5 by means of soldering and the other end to be connected to a female terminal formed at a top end of a wire harness 9. The wire harness 9 is connected to a battery of the automobile. Thus, the resistor wire 3 is energized by the battery through the wire harness 9, the female terminal, the male terminal 7, and the wide portion 5. The female terminal at the top end of the wire harness 9 is accommodated in a terminal accommodating chamber formed in a housing of a female connector 11, as illustrated in FIG. 2 (Japanese Utility Model Laid Open No. 78170/1981).

With the above-mentioned structure, the male terminal 7 is exposed or naked and subjected to an external force. This causes various disadvantages such as deformation of the male terminal, crack of the soldered part, and breakage of the glass plate.

SUMMARY OF THE INVENTION

In view of the above, it is an object of this invention to provide a connector adapted to be mounted on a glass plate, which is capable of reliably connecting a feeding terminal to a resistor wire printed on the glass plate without occurrence of deformation of a male terminal, undesirable release of the male terminal, and breakage of the glass plate.

In order to accomplish the above-mentioned object, this invention provides a connector for connecting a terminal and a conductor attached to a glass plate, comprising:

- a first connector fixedly mounted on the glass plate, the first connector having a fitting hood bridging the conductor, the fitting hood having a first opening which opens towards the conductor; and
- a second connector having a body to be fitted into the fitting hood, the body having a terminal accommodating chamber for accommodating the terminal and a second opening which allows a part of the terminal to project towards the conductor.

According to this invention, when the second connector is inserted and fitted into the fitting hood of the first connector, an elastic terminal of the second connector is brought into elastic contact with the conductor which is bridged by the fitting hood along a transversal direction.

DESCRIPTION OF THE PREFERRED EMBODIMENT

An embodiment of a connector adapted to be mounted on a glass plate according to this invention will be described with reference to the accompanying drawings hereinafter.

Figure 1:
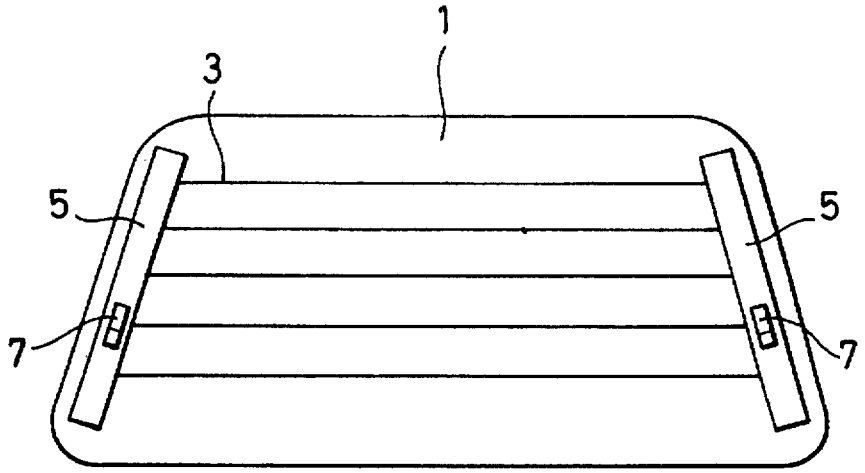
FIG. 1 PRIOR ART
FIG. 1 is a front view of a rear window glass of an automobile.
Figure 2:
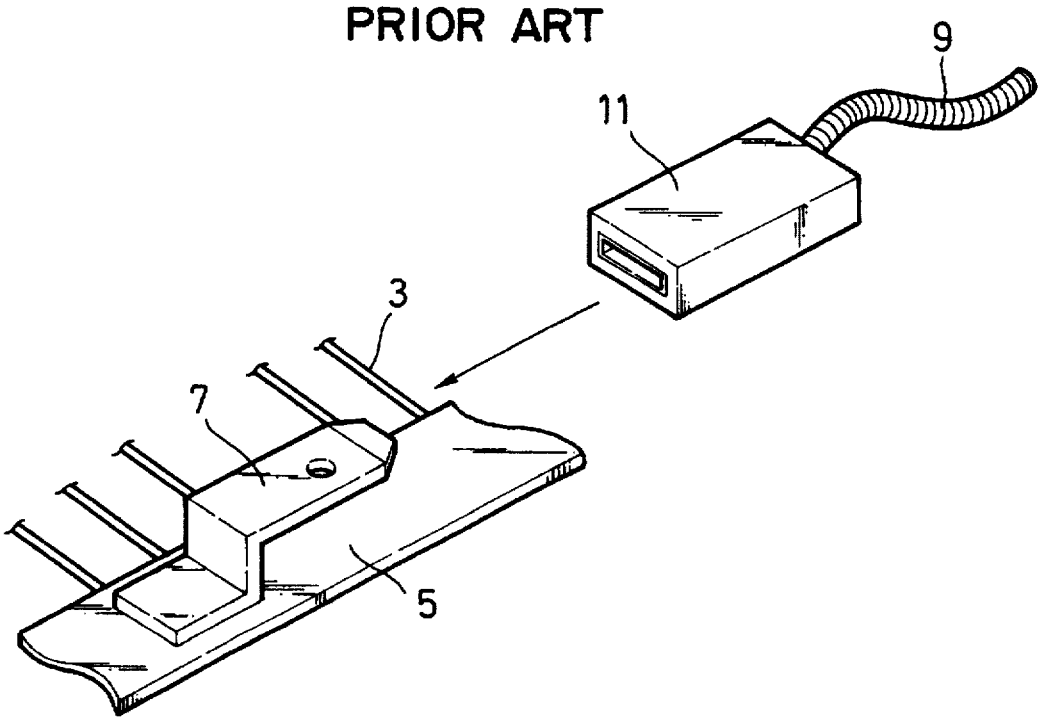
FIG. 2 PRIOR ART
FIG. 2 is a perspective view for describing a conventional structure for connecting a resistor wire and a feeding wire harness.
Figure 3:
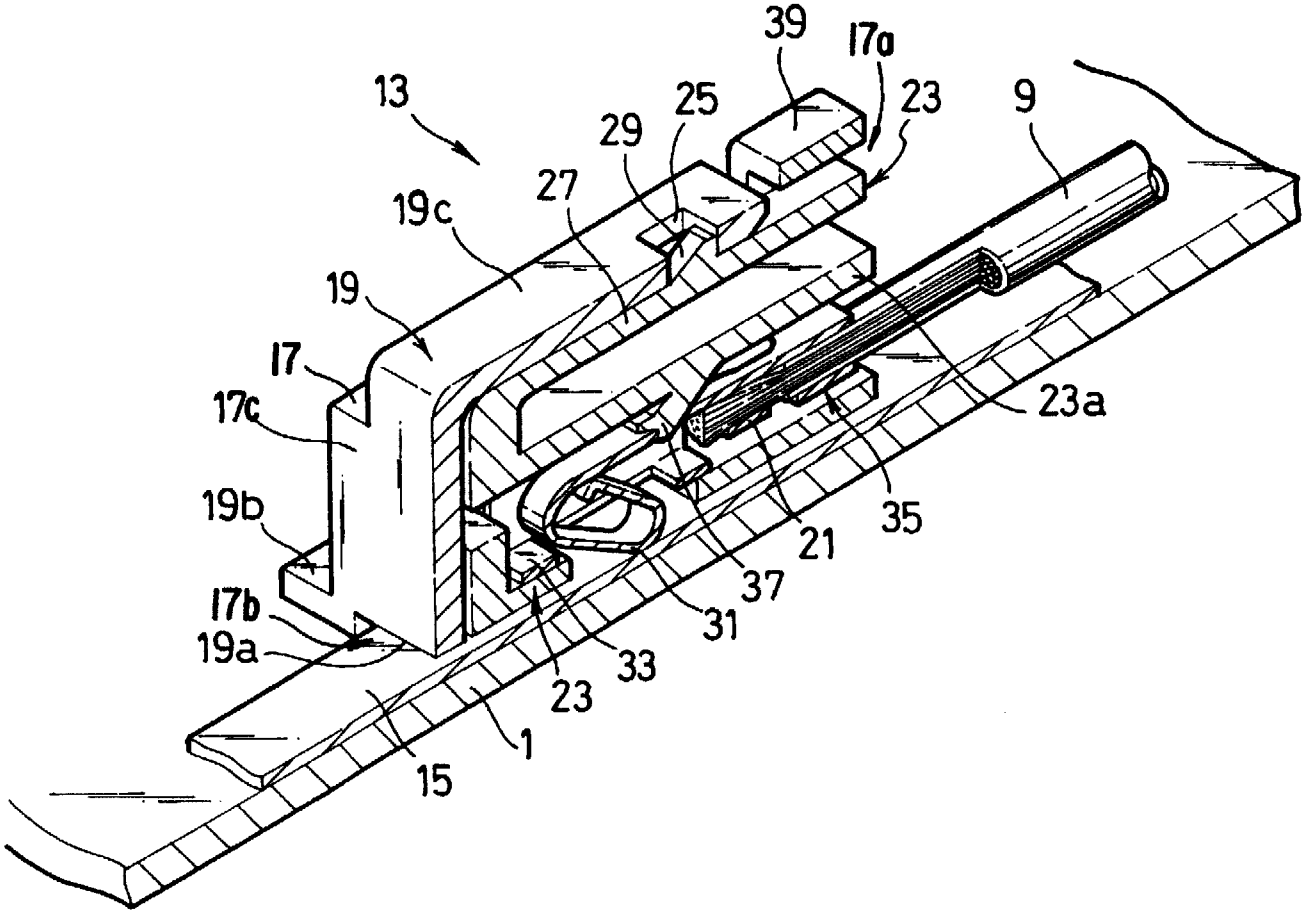
FIG. 3 is a perspective view of a connector adapted to be mounted on a glass plate according to an embodiment of this invention with a part cut away.
Figure 4:
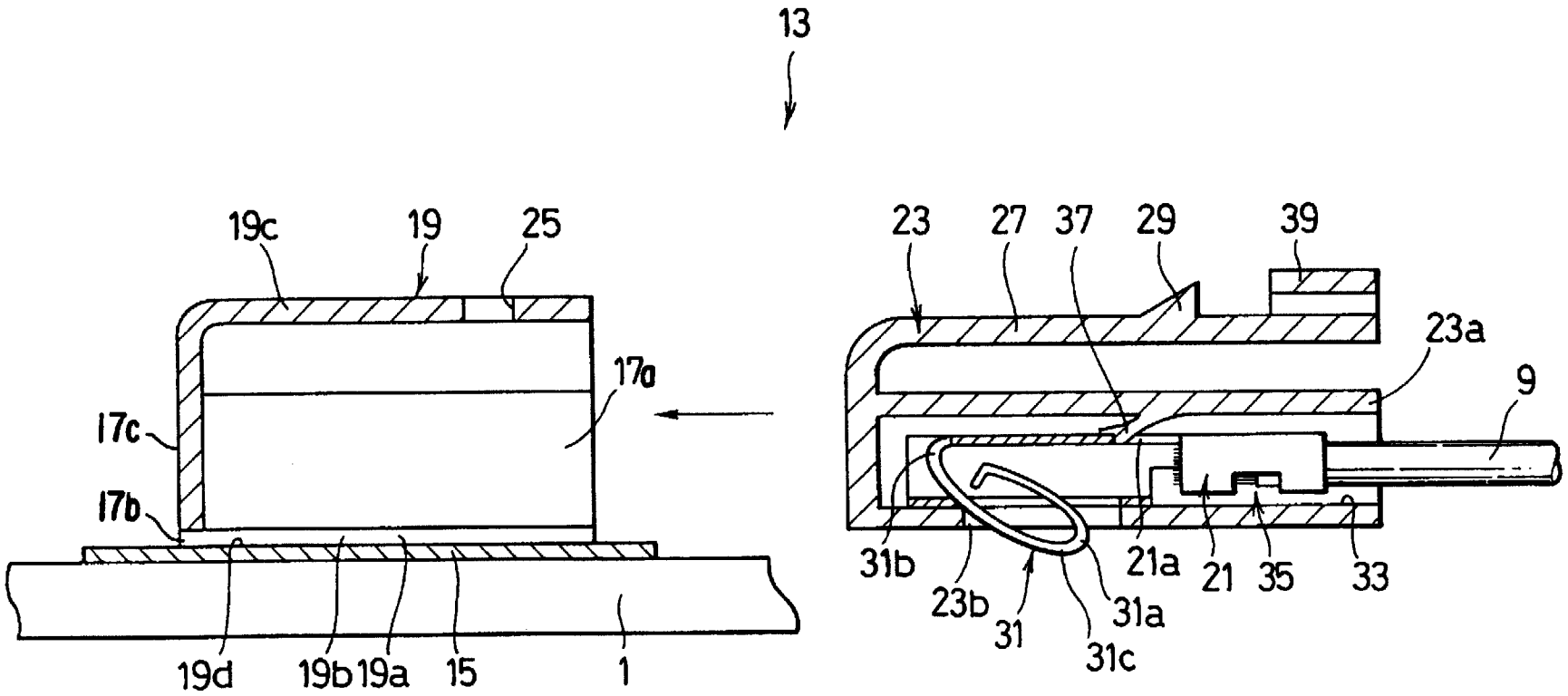
FIG. 4 is a sectional view of the connector adapted to be mounted on a glass plate illustrated in FIG. 3 in a condition before a male connector is fitted into a female connector.

FIGS. 3 and 4 show a connector 13 adapted to be mounted on a glass plate according to this invention. Referring to FIGS. 3 and 4, the connector 13 comprises a female connector 19 and a male connector 23. The female connector 19 has a fitting hood 17 bridging a conductor 15 along a transversal direction of the conductor 15. The male connector 23 is inserted and fitted into the fitting hood 17 of the female connector 19.

The female connector 19 has a bottom portion 19*d* provided with an insertion portion 19*a* which is formed at an intermediate area and extends in a longitudinal direction. The insertion portion 19*a* is open for insertion of the conductor 15. Thus, the insertion portion 19*a* defines a first opening which opens towards the conductor 15.

The fitting hood 17 further includes a second opening 17*a* for receiving the male connector 23, and a third opening 17*b* in a wall 17*c* opposite to the second opening 17*a*, the third opening 17*b* being smaller than the second opening 17*a*. A pair of attaching portions 19*b* are formed on both sides of the insertion portion 19*a* and laterally projects therefrom. The attaching portions 19*b* are attached onto a glass plate 1. A lock arm inserting portion 19*c* is integrally formed with the upper part of the fitting hood 17. The lock arm inserting portion 19*c* has an engaging hole 25.

On the other hand, the male connector 23 comprises a housing 23*a* and a flexible lock arm 27. The housing 23*a* has a terminal accommodating chamber 33. The flexible lock arm 27 is supported on the forward end of the housing 23*a* and extends in the rearward direction. It is noted here that the terms "forward" and "rearward" are used with respect to a fitting direction along which the male connector 23 is inserted into the female connector 19. The terminal accommodating chamber 33 accommodates an elastic terminal 21. The elastic terminal 21 comprises a crimp member 35 for crimping a wire 9, and an elastic contact member 31. The elastic contact member 31 is inwardly bent at its top end and again inwardly bent. Thus, the elastic contact member 31 has a first bent portion 31*a* and a second bent portion 31*b*. The elastic contact member 31 has, at its lower end, a contact portion 31*c* to be brought into contact with the conductor 15.

The housing 23*a* has a second opening 23*b* which allows the contact portion 31*c* of the elastic contact member 31 to project towards the conductor 15.

The terminal accommodating chamber 33 is provided with a flexible engaging piece 37 formed on the inner wall thereof. The flexible engaging piece 37 has a top end to be engaged with an engaging hole 21*a* formed on the elastic terminal 21. Thus, the elastic terminal 21 is prevented from belong released from the terminal accommodating chamber 33.

The flexible lock arm 27 has an engaging projection 29 to be engaged with the engaging hole 25 of the lock arm inserting portion 19*c*. The flexible lock arm 27 is further provided with a pressing portion 39 formed rearwardly of the engaging projection 29.

Figure 5:
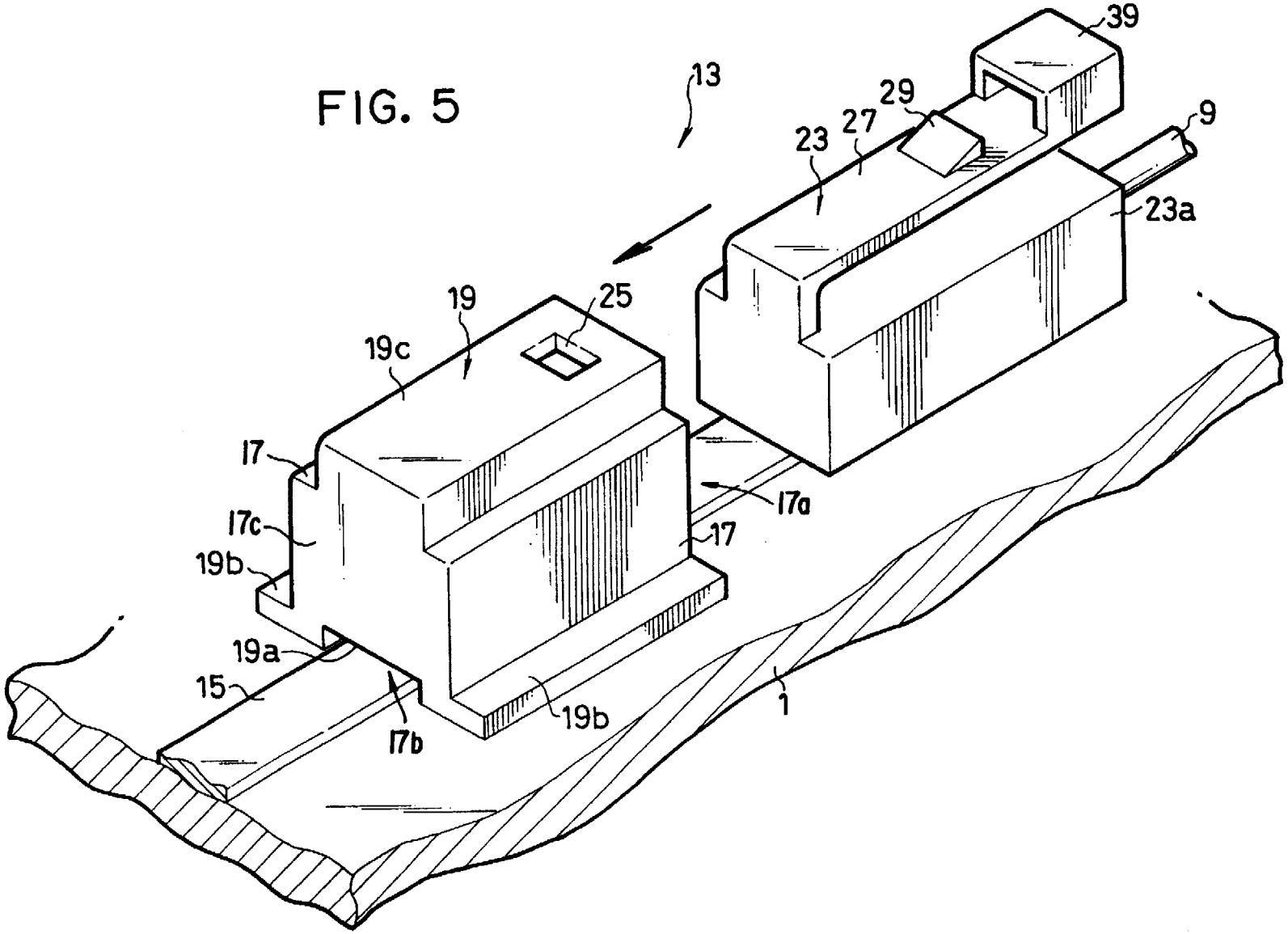
FIG. 5 is a perspective view of the connector of FIG. 4, showing the male connector ready to be inserted into the female connector having a fitting hood bridging a conductor affixed to the glass plate.

Referring now to FIG. 5, the female connector 19 is preliminarily attached onto the glass plate 1 to bridge the conductor 15. On the other hand, the male connector 23 accommodates the elastic terminal 21 formed at the end of the wire 9. When the male connector 23 is inserted and fitted into the fitting hood 17 of the female connector 19, the elastic contact member 31 of the elastic terminal 21 is put into elastic contact with the conductor 15 to provide electric connection therebetween. By engagement of the engaging projection 29 with the engaging hole 25, the male connector 23 is inhibited from being released from the fitting hood 17 of the female connector 19.

What is claimed is:

1. An electrical connector mounted on a glass plate of a vehicle for connecting a wire to a conductor fixed to a surface of the glass plate, comprising:

a terminal connected to said wire;

a first connector housing directly affixed to the surface of said glass plate, said first connector housing having a fitting hood bridging said conductor, said fitting hood being free of electrical continuity with said conductor, said fitting hood having a bottom opening which opens toward said conductor; and a single second connector housing having a body which is insertable into said fitting hood, said body having a terminal accommodating chamber for accommodating said terminal, said body having a bottom opening which allows a part of said terminal to project toward and to contact said conductor when said body is inserted into said fitting hood;

wherein said first connector housing has a pair of attaching portions, one on each of two opposing sides of said fitting hood, for directly affixing said fitting hood to said glass plate; and wherein said fitting hood has a second opening for receiving said body of said single second connector, and has a third opening provided in a wall opposite said second opening, said third opening being smaller than said second opening for receiving said conductor fixed to the surface of the glass plate, said first connector being formed to receive only said single second connector.

2. An electrial connector according to claim 1, wherein said first connector has an engaging hole, and said second connector has a flexible lock arm provided with an engaging projection which engages with said engaging hole when said body is inserted into said fitting hood.

3. An electrical connector according to claim 2, wherein said flexible lock arm rearwardly extends from a forward end of said body with respect to a direction of insertion of said body into said fitting hood, said flexible lock arm having a rear end which is a free end.

4. An electrical connector according to claim 1, wherein said body has a flexible engaging piece which engages with said terminal.

5. An electrical connector according to claim 1, wherein said conductor is a strip printed onto said surface of the glass plate, and wherein said terminal has a contact portion which contacts the surface of said conductor.

6. An electrical connector mounted on a glass plate of a vehicle for connecting a wire to a conductor fixed to a surface of the glass plate, comprising:

a terminal connected to said wire, said terminal comprising a contact member having a first bent portion and a second bent portion, said first bent portion being positioned at a distal end of said contact member and said second bent portion being positioned between said first bent portion and said wire;

a female housing having an attaching portion directly affixed to the surface of said glass plate, and a fitting hood bridging said conductor, said fitting hood being free of electrical continuity with said conductor, said fitting hood having a bottom opening which opens toward said conductor; and a single male connector having a body which is insertable into said fitting hood, said body having a terminal accommodating chamber for accommodating said terminal and a bottom opening which allows said first bent portion of said contact member to project toward and to contact said conductor when said body is inserted into said fitting hood;

said fitting hood having a second opening for receiving said body of said single male connector, and having a third opening provided in a wall opposite said second opening, said third opening being smaller than said bottom opening for receiving said conductor fixed to the surface of the glass plate, said female housing being formed to receive only said single male connector.

7. An electrical connector according to claim 6, wherein said female connector has an engaging hole, and said male connector has a flexible lock arm provided with an engaging projection which engages with said engaging hole when said body is inserted into said fitting hood.

8. An electrical connector according to claim 7, wherein said flexible lock arm rearwardly extends from a forward end of said body with respect to a direction of insertion of said body into said fitting hood, said flexible lock arm having a rear end which is a free end and a press portion.

9. An electrical connector according to claim 6, wherein said body has a flexible engaging piece which engages with said terminal.

10. An electrical connector according to claim 6, wherein said conductor is a strip printed onto said surface of the glass plate, and wherein said terminal has a contact portion which contacts the surface of said conductor.

11. An electrical connector according to claim 6, wherein said first connector housing has a pair of attaching portions which are attached onto said glass plate.

12. An electrical connector mounted on a transparent glass plate for connecting a wire to a conductor fixed to a surface of the glass plate of a vehicle, comprising:

an elastic terminal having a crimp member for crimping a wire and an elastic contact member having a first bent portion and a second bent portion, said first bent portion being positioned at a distal end of said elastic contact member for contact with said conductor, said elastic terminal having a first engaging hole;

a female connector housing having a fitting hood bridging said conductor along a transverse direction of said conductor and free of electrical continuity therebetween, said fitting hood having two sides and a bottom opening which opens toward said conductor and a pair of attaching portions which laterally project from said two sides of said fitting hood and which are directly affixable to the surface of said glass plate, said female connector having a second engaging hole;

a single male connector having a body insertable into said fitting hood, said body having a terminal accommodating chamber for accommodating said elastic terminal and a bottom opening which allows said first bent portion of said elastic terminal to project toward and to contact said conductor, said body having a flexible engaging piece formed on an inner wall of said terminal accommodating chamber, said flexible engaging piece engaging with said first engaging hole when said elastic terminal is inserted into said terminal accommodating chamber; and a flexible lock arm rearwardly extending from a forward end of said body of said single male connector relative to a direction of insertion of said single male connector, said flexible lock arm having an engaging projection which engages with said second engaging hole of said female connector when said body is inserted into said fitting hood and said flexible lock arm having a pressing portion formed at a free end of said flexible lock arm;

said fitting hood having a second opening for receiving said body of said single male connector, and having a third opening provided in a wall opposite said second opening, said third opening being smaller than said bottom opening for receiving said conductor fixed to the surface of the glass plate, said female housing being formed to receive only said single male connector.

13. An electrical connector mounted on a glass plate of a vehicle for connecting a wire to a conductor fixed to a surface of the glass plate, comprising:

a terminal connected to said wire, said terminal comprising a contact member having a first bent portion and a second bent portion, said first bent portion being positioned at a distal end of said contact member and said second bent portion being positioned between said first bent portion and said wire;

a first connector housing directly affixed to the surface of said glass plate, said first connector housing having a fitting hood bridging said conductor, said fitting hood being free of electrical continuity with said conductor, said fitting hood having a bottom opening which opens toward said conductor; and a single second connector housing having a body which is insertable into said fitting hood, said body having a terminal accommodating chamber for accommodating said terminal, said body having a bottom opening which allows said first bent portion of said contact member to project toward and to contact said conductor when said body is inserted into said fitting hood;

wherein said first connector includes attaching means for directly affixing said fitting hood to said glass plate; and said fitting hood having a second opening for receiveing said body of said single second connector, and having a third opening provided in a wall opposite said second opening, said third opening being smaller than said bottom opening for receiving said conductor fixed to the surface of the glass plate, said first connector being formed to receive only said single second connector.

* * * * *